US006067432A

United States Patent [19]

Huang

[11] Patent Number: 6,067,432

[45] Date of Patent: May 23, 2000

[54] DEVELOPER CONTAINER

[75] Inventor: Ya-Li Huang, Taichung County, Taiwan

[73] Assignee: General Plastic Industrial Co., Ltd., Taichung County, Taiwan

[21] Appl. No.: 09/235,599

[22] Filed: Jan. 20, 1999

[51] Int. Cl.[7] ..... G03G 15/08

[52] U.S. Cl. ..... 399/262; 222/DIG. 1

[58] Field of Search ..... 222/DIG. 1, 325, 222/167; 399/262, 119, 120; 141/383, 389, 363

[56] References Cited

U.S. PATENT DOCUMENTS 4,456,154 6/1984 Herriman ..... 222/DIG. 1
5,722,020 2/1998 Matsuoka et al. ..... 399/262

*Primary Examiner*—Arthur T. Grimley
*Assistant Examiner*—Greg Moldafsky
*Attorney, Agent, or Firm*—Pro-Techtor International Services

[57] ABSTRACT

A developer container for with a developer replenishing device in a copier or the like, the developer container including a cylindrical container body having a neck at its front end, a plurality of indented parallel guide ways around the periphery thereof for stirring up contained developer upon rotary motion of the container body, and two hollow projecting portions at two opposite sides of the neck, and a dispensing end cap fastened to the neck of the container body, the dispensing end cap having a hollow cylindrical mounting portion at one end inserted into the neck of the container body, a hollow cylindrical dispensing portion disposed at an opposite end outside the neck of the container body, a plurality of developer inlets for guiding in developer from the container body, a plurality of developer outlets for guiding developer out of the end cap, and a plurality of guide grooves on an inside wall thereof for guiding developer, from the developer inlets to the developer outlets.

4 Claims, 3 Drawing Sheets

DEVELOPER CONTAINER

BACKGROUND OF THE INVENTION

The present invention relates to a developer container for use with a developer-replenishing device in a copier, facsimile apparatus, printer or similar electrophori-graphic image forming apparatus.

A developer container for use with a developer replenishing device in a copier, facsimile apparatus, printer or similar electrophori-graphic image forming apparatus, has a spiral guide rib on the inside around the periphery for guiding contained developer to its front neck. When the developer-replenishing device rotates the developer container, a static electricity is produced at the spiral guide rib, causing developer to be adhered to the spiral guide rib. Further, when the developer container is rotated, contained developer is directly forced out of the neck of the container at a high output rate, and much dispensed developer may be wasted.

SUMMARY OF THE INVENTION

The present invention has been accomplished to provide a developer container, which eliminates the aforesaid problems. According to one aspect of the present invention, indented parallel guide ways are provided at the container body of the developer container around its periphery. The indented parallel guide ways stir up developer upon rotary motion of the container body of the developer container, without causing developer to be adhered to the container body of the developer container. According to another aspect of the present invention, a dispensing end cap is provided at the neck of the container body of the developer container to let developer be distributed out of the neck of the container body of the developer container smoothly.

DETAILED DESCRIPTION OF THE PREFERRED EMBODIMENT

Figure 1:
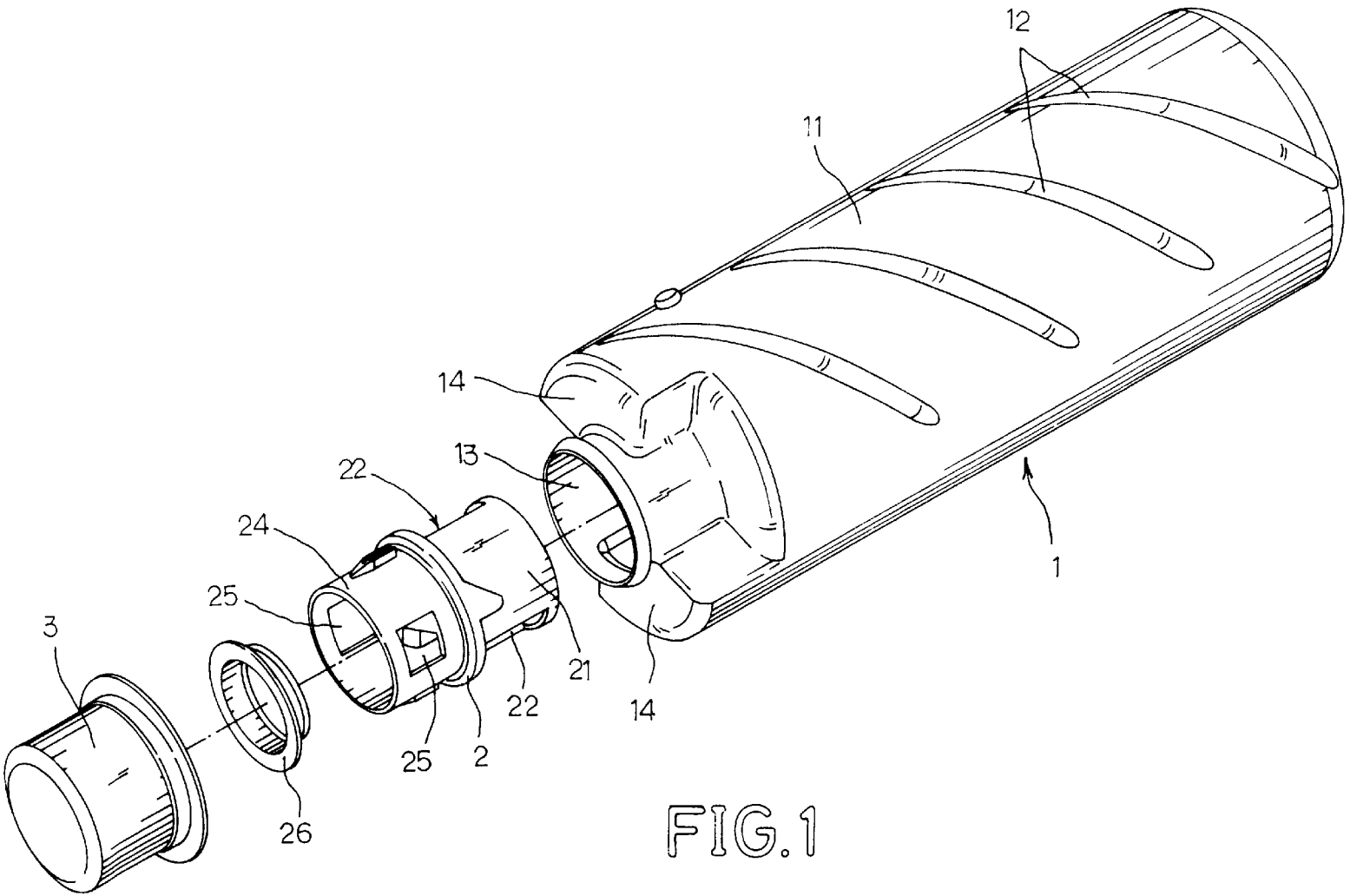
FIG. 1 is an exploded view of a developer container according to the present invention.

Referring to FIGS. from 1 through 4, a developer container in accordance with the present invention is generally comprised of a container body 1, a dispensing end cap 2, and a sealing cap 26.

The container body 1 comprises a neck 13 at its one end, a plurality of indented guide ways 12 obliquely provided around the periphery 11 thereof and arranged in parallel, and two hollow projecting portions 14 at two opposite sides of the neck 13.

Figure 3:
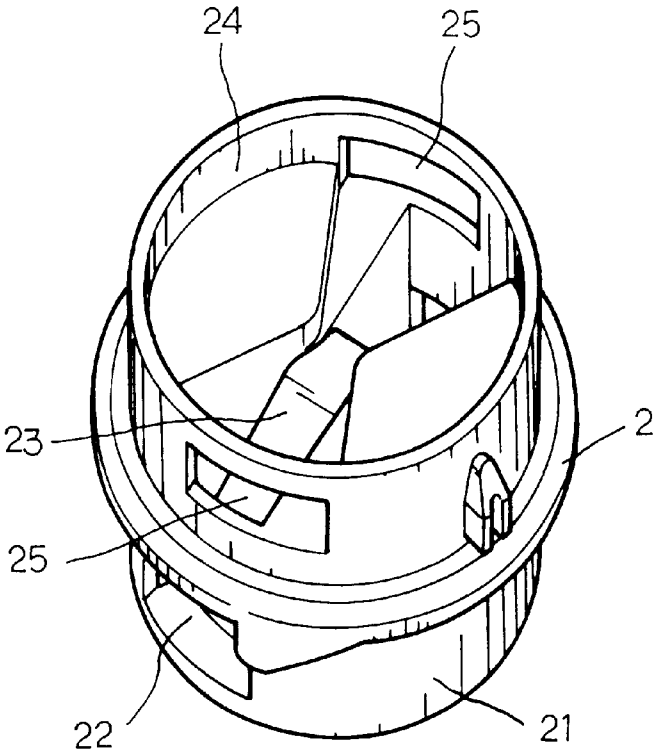
FIG. 3 shows the end cap of FIG. 2 viewed from another direction.
Figure 2:
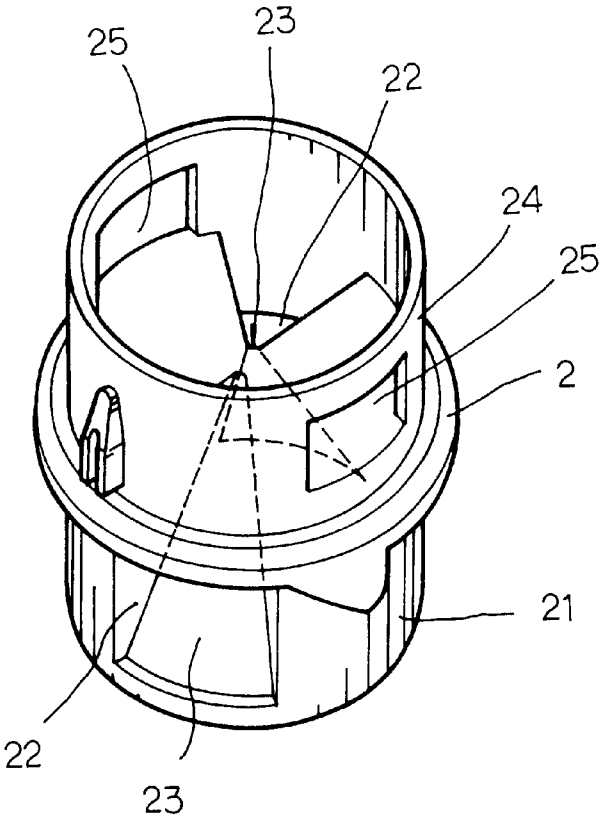
FIG. 2 is a perspective view of an end cap according to the present invention.
Figure 4:
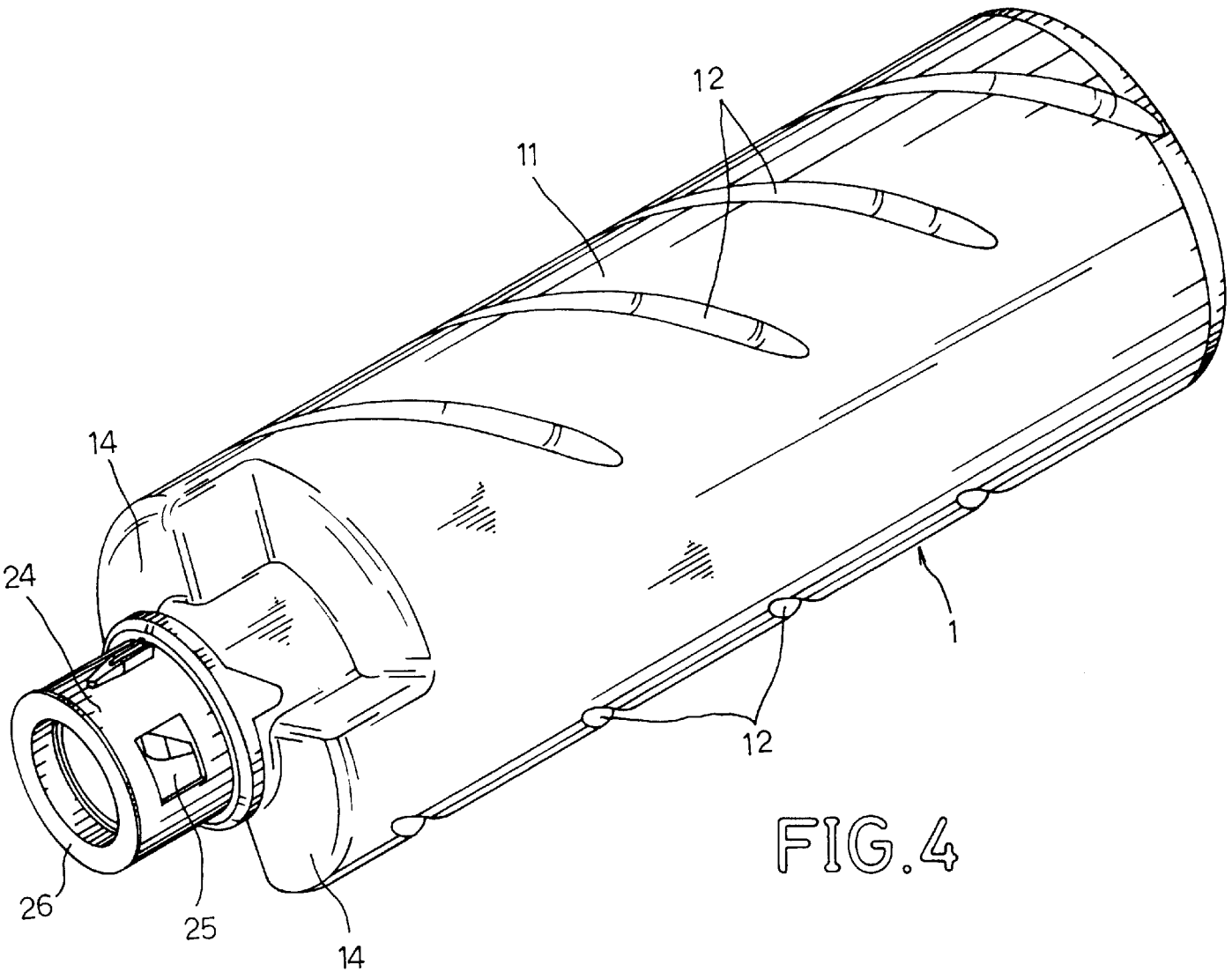
FIG. 4 is a perspective view of the developer container shown in FIG. 1.

The dispensing end cap 2, is fastened to the neck 13 of the container body 1, comprising a hollow cylindrical mounting portion 21 at one end inserted into the neck 13, and suspended inside the container body 1, a hollow cylindrical dispensing portion 24 disposed at an opposite end outside the neck 13, a plurality of developer inlets 22 provided at the mounting portion 21 for guiding in developer from the container body 1, a plurality of developer outlets 25 provided at the dispensing portion 24 for guiding developer out of the dispensing end cap 2, and a plurality of guide grooves 23 on the inside wall thereof for guiding developer from the developer inlets 22 to the developer outlets 25 (see FIGS. 2 and 3). The guide grooves 23 can have an arched or flat bottom wall, a bottom wall of any of a variety of shapes.

When the container body 1 of the developer container is rotated by the developer replenishing device in the copier, developer is stirred up by the indented spiral guide ways 12 and guided toward the hollow projecting portions 14. Because developer is well stirred up by the indented guide ways 12, no static electricity is produced at the container body 1. Therefore, developer can be smoothly guided to the hollow projecting portions 14. When developer is delivered to the hollow projecting portions 14, it immediately falls to the developer inlets 22 into the dispensing end cap 2, and then guided by the guide grooves 23 to the outside of the dispensing end cap 2 through the outlets 25.

Furthermore, an outer cap 3 may be closed on the dispensing portion 24 of the end cap 2 to keep the sealing cap 26 from sight.

While only one embodiment of the present invention has been shown and described, it will be understood that various modifications and changes could be made thereunto without departing from the spirit and scope of the invention disclosed.

What the invention claimed is:

1. A developer container use for with a developer replenishing device in a copier, facsimile apparatus, printer or similar electrophori-graphic image forming apparatus, the developer container comprising:

a container body, said container body comprising a neck at a front end thereof, a plurality of indented guide ways obliquely provided around the periphery of said container body and arranged in parallel, and two hollow projecting portions at two opposite sides of said neck; and a dispensing end cap fastened to the neck of said container body, said dispensing end cap comprising a hollow cylindrical mounting portion at one end inserted into the neck of said container body and suspended inside said container body, a hollow cylindrical dispensing portion disposed at an opposite end outside the neck of said container body, a plurality of developer inlets provided at said mounting portion and facing said hollow projecting portions of said container body for guiding in developer from said container body, a plurality of developer outlets provided at said dispensing portion for guiding developer out of said end cap, and a plurality of guide grooves on an inside wall of said end cap for guiding developer from said developer inlets to said developer outlets.

2. The developer container of claim 1 wherein the guide grooves of said dispensing end cap have an arched bottom wall.

3. The developer container of claim 1 wherein the guide grooves of said dispensing end cap have a flat bottom wall.

4. The developer container of claim 1 further comprising an outer cap covered on the dispensing portion of said dispensing end cap.

* * * * *